US011719521B2

(12) United States Patent
Burke et al.

(10) Patent No.: US 11,719,521 B2
(45) Date of Patent: Aug. 8, 2023

(54) BULLET SEATING DIE

(71) Applicant: AOB Products Company, Columbia, MO (US)

(72) Inventors: Justin Burke, Columbia, MO (US); James Tayon, Moberly, MO (US); Michael Lindsay, Columbia, MO (US); Matthew Kinamore, Columbia, MO (US); Curtis Smith, Columbia, MO (US); Jarrod Grove, Columbia, MO (US); Michael Cottrell, Ashland, MO (US)

(73) Assignee: AOB PRODUCTS COMPANY, Columbia, MO (US)

( * ) Notice: Subject to any disclaimer, the term of this patent is extended or adjusted under 35 U.S.C. 154(b) by 0 days.

(21) Appl. No.: 17/444,256

(22) Filed: Aug. 2, 2021

(65) Prior Publication Data

US 2022/0034637 A1 Feb. 3, 2022

Related U.S. Application Data

(60) Provisional application No. 63/059,398, filed on Jul. 31, 2020.

(51) Int. Cl.
*F42B 33/00* (2006.01)

(52) U.S. Cl.
CPC ..... *F42B 33/005* (2013.01)

(58) Field of Classification Search
USPC ..... 86/43
See application file for complete search history.

(56) References Cited

U.S. PATENT DOCUMENTS 2,571,272 A * 10/1951 Martin ..... F42B 33/10 86/24
2,700,915 A * 2/1955 Pattison ..... F42B 33/001 86/39
2,826,111 A * 3/1958 Thompson, Jr. ..... F42B 33/10 86/43

(Continued)

OTHER PUBLICATIONS

Web Pages relating to New RGBS Matchmaster Dies! Tested in 6mm Creedmoor—Ultimate Reloader (Aug. 14, 2019), https://ultimatereloader.com/2019/08/14/new-rcbs-matchmaster-dies-tested-in-6mm-creedmoor/, 37 pages.

(Continued)

*Primary Examiner* — Derrick R Morgan
(74) *Attorney, Agent, or Firm* — Stinson LLP

(57) ABSTRACT

A bullet seating die for use with an ammunition press to seat a bullet in a case includes a die housing having an ammunition press mount for mounting the bullet seating die on the ammunition press. The die housing defines a bullet receiving space having an open end and a side window in communication with the bullet receiving space. The side window sized and shaped to permit the bullet to be inserted therethrough to position the bullet in the bullet receiving space. A seating stem is supported by the die housing. The seating stem is arranged to engage the bullet to press the bullet into the case when the ammunition press is operated. A spring biases the seating stem away from the open end of the bullet receiving space to permit the bullet to be inserted through the side window and into the bullet receiving space.

24 Claims, 10 Drawing Sheets

(56) References Cited

U.S. PATENT DOCUMENTS 2,829,554 A * 4/1958 Sawyer ..... F42B 33/001 86/43
3,049,044 A * 8/1962 English ..... F42B 33/04 86/24
3,204,518 A * 9/1965 Jackson ..... F42B 33/001 86/43
3,336,830 A * 8/1967 Lester, Jr. ..... F42B 33/002 86/45
3,440,923 A * 4/1969 Purdie ..... F42B 33/10 86/43
4,077,319 A * 3/1978 Edmisten ..... F42B 5/025 101/379
4,336,739 A * 6/1982 Alexander ..... F42B 33/001 86/24
4,573,392 A * 3/1986 Mantel ..... F42B 33/002 86/44
4,637,291 A * 1/1987 Alexander ..... F42B 33/04 86/24
4,862,567 A * 9/1989 Beebe ..... F42B 33/005 86/43
5,179,243 A * 1/1993 Schroeder ..... F42B 33/002 86/28
5,649,465 A * 7/1997 Beebe ..... F42B 33/10 86/24
6,244,154 B1 * 6/2001 Beebe ..... F42B 33/005 86/24
7,703,369 B1 * 4/2010 Lee ..... F42B 33/10 86/43
10,794,676 B1 * 10/2020 Aerni ..... F42B 33/10
2016/0040969 A1 * 2/2016 Kleinschmit ..... F42B 33/001 86/43

OTHER PUBLICATIONS

Instruction Manual for RGBS Gold Medal Dies, Product Instructions, 12 pages, at least as early as Aug. 14, 2019.

* cited by examiner

BULLET SEATING DIE

CROSS-REFERENCE TO RELATED APPLICATION

This application claims priority to U.S. Provisional Application No. 63/059,398, filed Jul. 31, 2020, the entirety of which is hereby incorporated by reference.

FIELD

The present disclosure generally relates to ammunition loading equipment, and more particularly to a bullet seating die.

BACKGROUND

Referring to FIG. 1, a bullet 1 can be seated into a charged case or cartridge 2 using an ammunition press, such as the ammunition press 3. A charged case 2 is a case that has been resized and primed, has powered placed into it and is ready to accept a bullet. The ammunition press 3 includes a threaded receiver at the top into which a conventional seating die 4 is threadably attached. Typically, conventional seating dies are caliber and case specific, meaning each seating die can only be used with one caliber size and one type/size of case. To seat the bullet 1 in the case 2, the case is placed on the ammunition press and then the bullet is placed on the top of the case. The ammunition press 1 is then operated to move the case 2 and bullet 1 upward into the seating die 4. As the bullet 1 is raised into the seating die 4, the bullet engages the seating die, preventing further upward movement and thereby pressing the bullet into the case 2 as the case continues to be moved upward by the ammunition press 3. After the bullet 1 is seated in the case 2, the user resets the ammunition press and can repeat the process for another bullet and case.

SUMMARY

In one aspect, a bullet seating die for use with an ammunition press to seat a bullet in a case comprises a die housing having an ammunition press mount configured to mount the bullet seating die on the ammunition press. The die housing defines a bullet receiving space having an open end. The die housing defines a side window in communication with the bullet receiving space and sized and shaped to permit the bullet to be inserted therethrough to position the bullet in the bullet receiving space. A seating stem is supported by the die housing within the bullet receiving space. The seating stem is arranged to engage the bullet to press the bullet into the case when the ammunition press is operated. A spring biases the seating stem away from the open end of the bullet receiving space so that the seating stem is positioned relative to the side window to permit the bullet to be inserted through the side window and into the bullet receiving space.

In another aspect, a method of seating a bullet in a case using an ammunition press comprises placing the bullet in a bullet receiving space of a bullet seating die mounted to the ammunition press and operating the ammunition press to seat the bullet in the case. The placing includes inserting the bullet through a side window of the bullet seating die under a seating stem biased away from a lower end of the side window. The seating stem does not need to be moved to place the bullet into the bullet receiving space.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
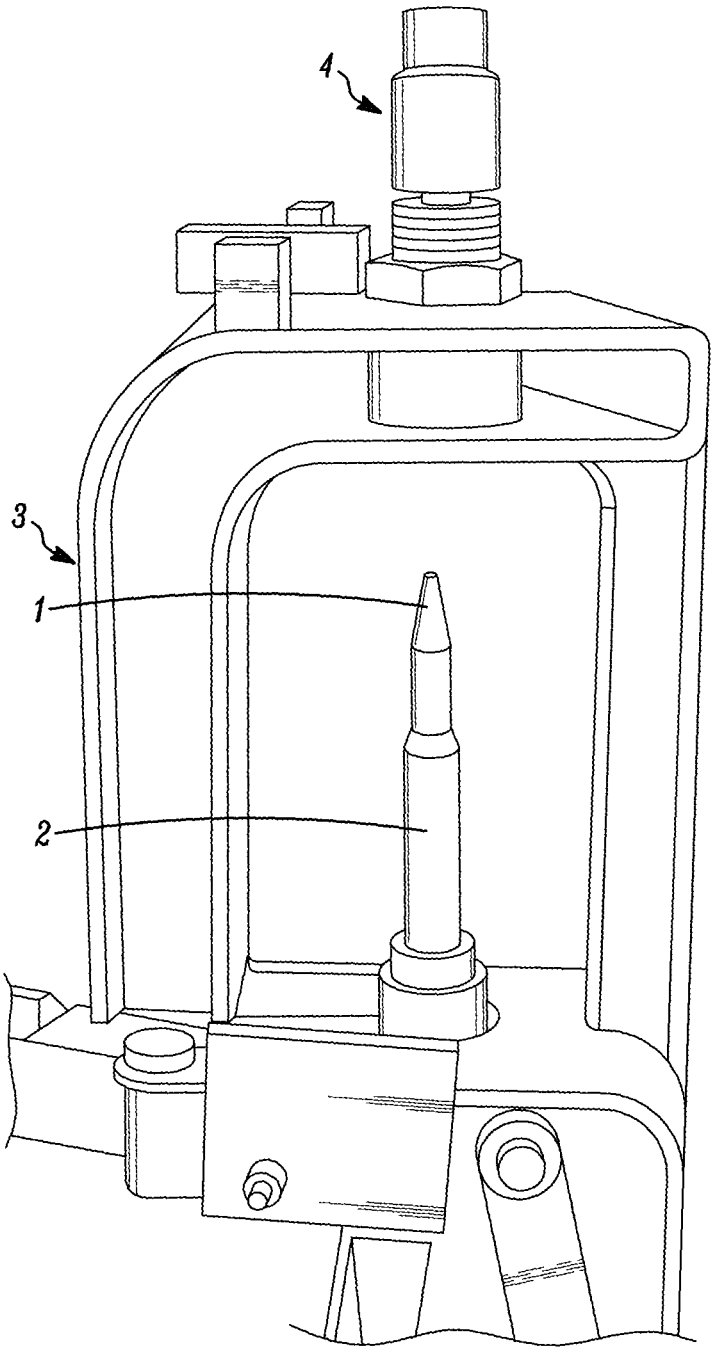
FIG. 1 (PRIOR ART)
FIG. 1 is an illustration of an ammunition press with a conventional seating die.
Figure 2:
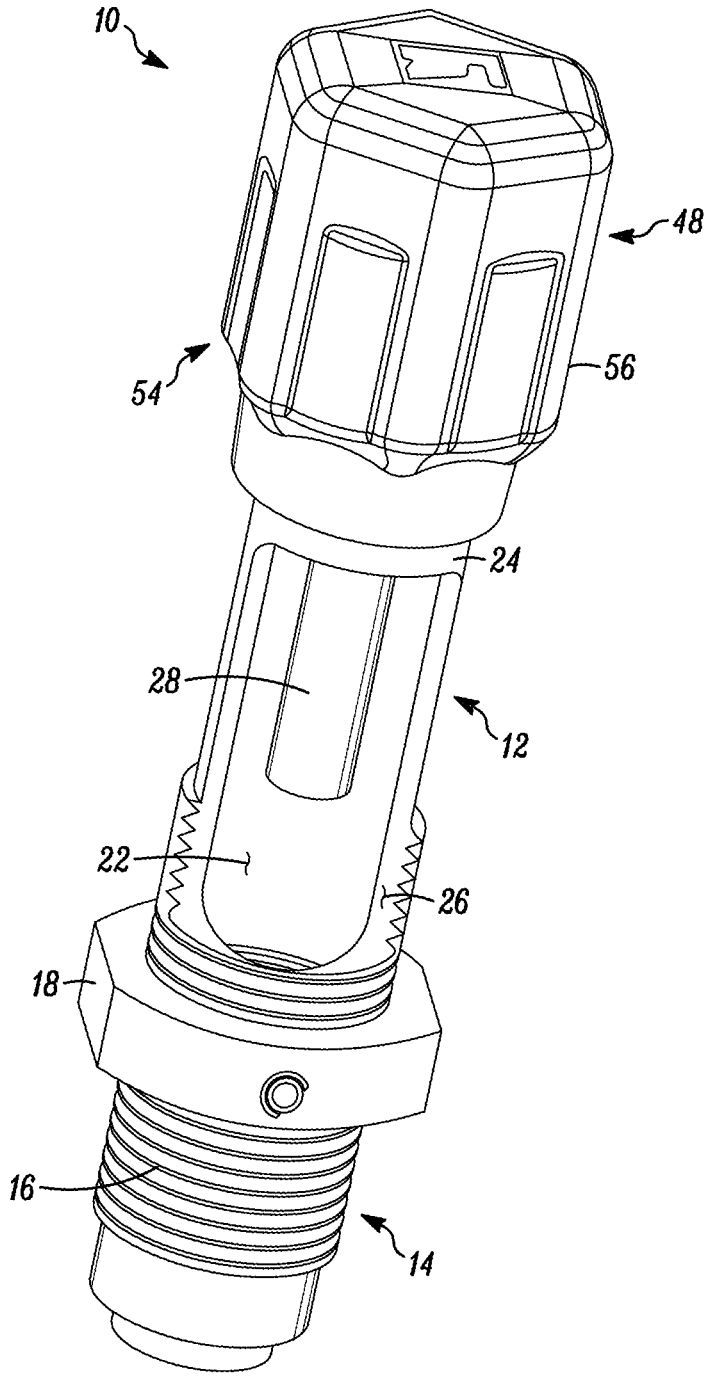
FIG. 2 is a perspective of a bullet seating die according to one embodiment of the present disclosure.
Figure 3:
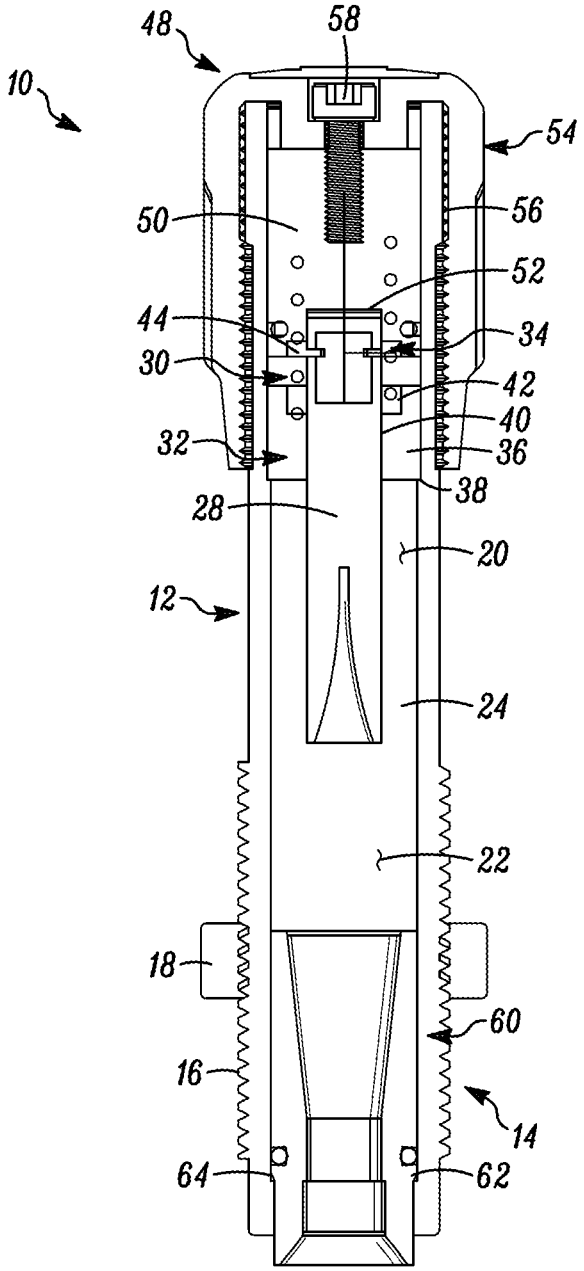
FIG. 3 is a cross-section of the bullet seating die.
Figure 4:
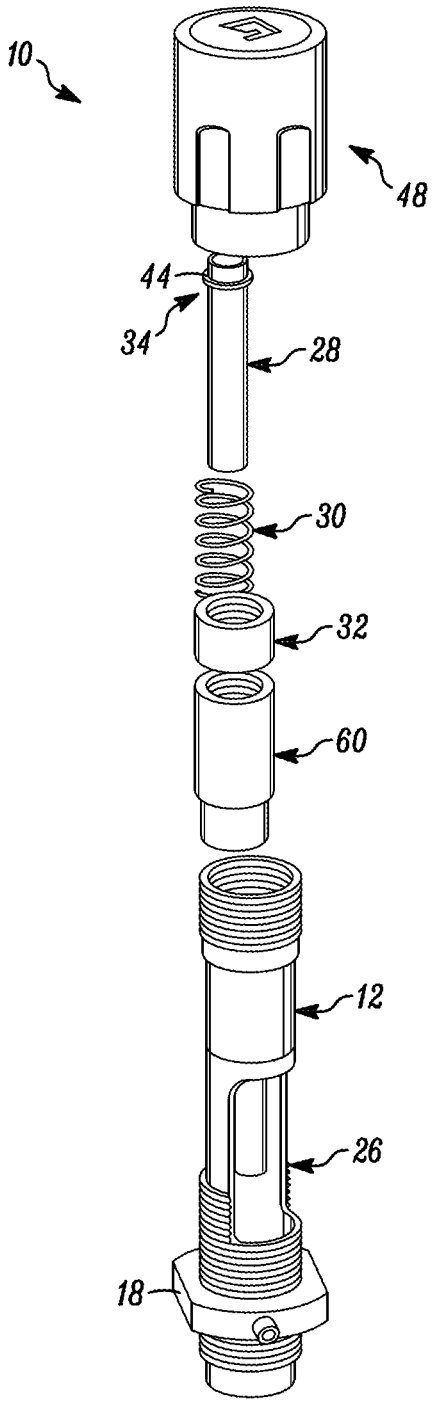
FIG. 4 is an exploded view of the bullet seating die.

Referring to FIGS. 2-4, one embodiment of a bullet seating die of the present disclosure is generally indicated by reference numeral 10. The bullet seating die 10 is used with an ammunition press, such as the ammunition press 3 of FIG. 1, to seat a bullet 1 in a case 2. The bullet seating die 10 includes a die housing 12. The die housing 12 includes an ammunition press mount 14 configured to mount the bullet seating die 10 to the ammunition press 3. In the illustrated embodiment, the ammunition press mount 14 comprises external threads 16 for threadably coupling the die housing 12 to the ammunition press 3. The bullet seating die 10 also includes a lock nut or ring 18 threadably mountable on the threads 16. After the die housing 12 is threadably mounted on the ammunition press 3, the lock nut 18 can be used to secure the bullet seating die 10 to the ammunition press by engaging the lock nut against the ammunition press. Other ways of mounting the bullet seating die 10 on the ammunition press 3 are within the scope of the present disclosure.

The die housing 12 is generally elongate and has opposite first and second ends. The die housing 12 defines an elongate or longitudinal bore 20 having open ends at each end of the die housing. As will become apparent, the longitudinal bore 20 receives various different components of the bullet seating die 10 and the bullet 1. In particular, the die housing 12 defines (broadly, at least partially defines) a bullet receiving space 22. The bullet receiving space 22 is a portion of the longitudinal bore 20. The bullet receiving space 22 has an open end (e.g., an open lower end). The case 2 moves through the open end and into the bullet receiving space 22 when the bullet 1 is seated in the case. The open end of the bullet receiving space 22 is generally coextensive with one of the open ends (e.g., the lower end) of the bore 20. In the illustrated embodiment, the die housing 12 includes a generally cylindrical side wall 24 defining the bore 20. The die housing 12 also defines a side window 26. The side window 26 is in communication with the bullet receiving space 22 (broadly, the longitudinal bore 20). The side window 26 is sized and shaped to permit the bullet 1 to be inserted therethrough to position the bullet in the bullet receiving space 22. This allows the bullet 1 to be inserted laterally into die housing 12, making it easier to position the bullet 1 for seating with the case 2 over conventional bullet seating dies. For example, the conventional seating die 4 shown in FIG. 1 requires an operator to balance the bullet 2 on top of the case 1 to position the bullet for seating, which can be difficult.

The bullet seating die 10 includes a seating stem 28 supported by the die housing 12. The seating stem 28 is generally elongate and cylindrical. The seating stem 28 (e.g., an end thereof) is arranged to engage the bullet 1 to press the bullet into the case 2 when the ammunition press 3 is operated. The seating stem 28 resists the upward movement of the bullet 1 to force the bullet into the case 2 when the ammunition press is operated. The end (e.g., lower end) of the seating stem 28 that engages the bullet 1 can define a recess sized and shaped to receive the tip of the bullet. The seating stem 28 is disposed in the bullet receiving space 22 (broadly, the bore 20). The seating stem 28 is positioned relative to the side window 26 in the die housing 12 such that the seating stem does not block or otherwise inhibit the bullet 1 from being inserted into the bullet receiving space 22. In the illustrated embodiment, the bullet seating die 10 includes a spring 30 that positions the seating stem 28. The spring 30 biases the seating stem 28 away from the open end of the bullet receiving space 22 (e.g., away from a lower end of the side window 26) so that the seating stem is positioned relative to the side window to permit the bullet to be inserted through the side window and into the bullet receiving space 22. The spring 30 holds the seating stem 28 up to keep the seating stem out of the way of the bullet 1. The spring 30 also allows the position of the seating stem 28 to be adjusted, as described in more detail below.

Figure 5:
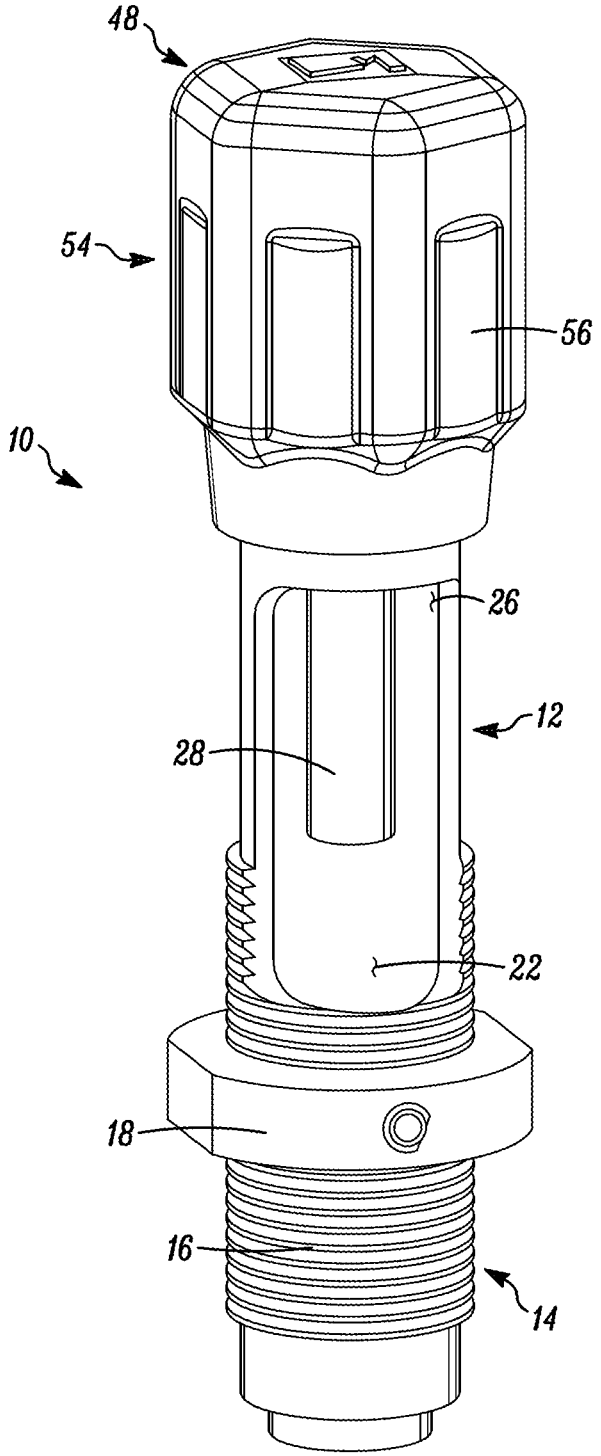
FIG. 5 is a front perspective of the bullet seating die.
Figure 6:
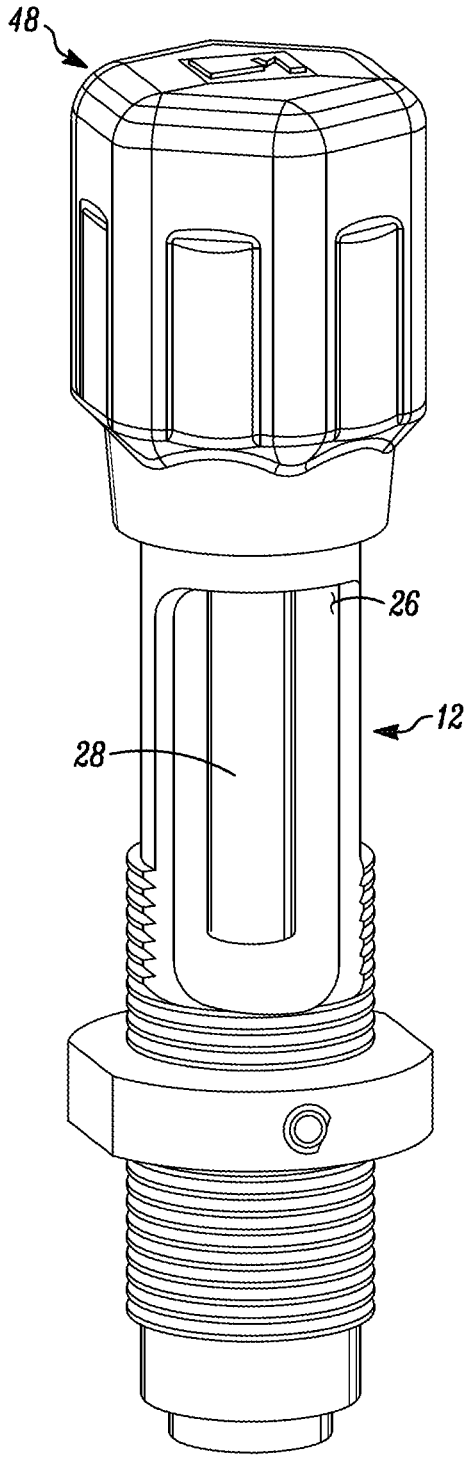
FIG. 6 is a front perspective of the bullet seating die showing the position of a seating stem when not raised by a spring.

The seating stem 28 is positioned, via the spring 30, to prevent the seating stem from blocking the side window 26 and inhibiting the bullet 1 from being inserted into the bullet receiving space 22. Specifically, the seating stem 28 is positioned within the die housing 12 such that the lower end of the seating stem is spaced apart by a sufficient distance from the lower end of the side window 26 to permit the bullet 1 to be inserted therebetween to position the bullet in the bullet receiving space 22. FIGS. 2 and 5 show the seating stem 28 positioned to create sufficient clearance to permit the bullet 1 to be inserted through the side window 26 and into the bullet receiving space 22. FIG. 6 shows a version of the bullet seating die 10 where the die lacks a spring 30 or other element positioning the seating stem 28 relative to the side window such that an insufficient amount of clearance exists for inserting the bullet 1 into the bullet receiving space. The seating stem positioning shown in FIG. 6 is similar to conventional bullet seating dies having a seating stem that is free floating (e.g., is free to move downward under the influence of gravity) such that a user has to manually raise the seating stem in order to be able to place the bullet 1 in the bullet receiving space through the side window. Accordingly, it is easier to place a bullet 1 into the bullet receiving space 22 of the bullet seating die 10 of the present disclosure over corresponding conventional seating dies because the user does not need to move (e.g., lift) the seating stem 28 out of the way to create enough clearance to insert the bullet into the bullet receiving space.

Figure 10A:
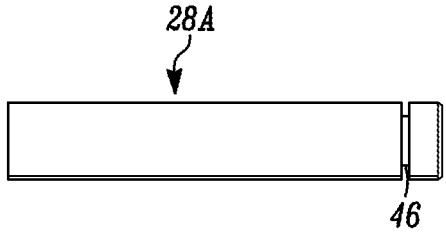
FIGS. 10A-C are side views of different sized seating stems of the bullet seating die kit.
Figure 10B:
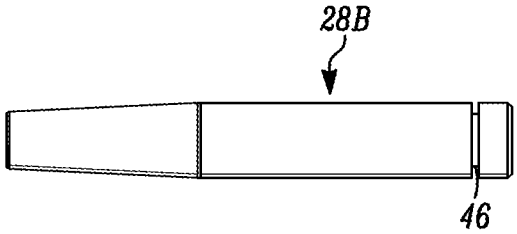
Figure 10C:
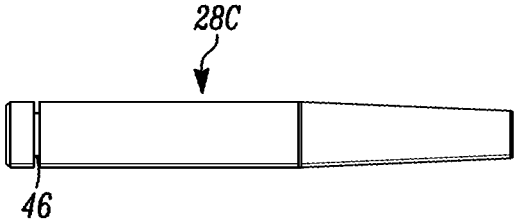

Referring to FIGS. 3 and 4, the spring 30 is operatively disposed between the seating stem 28 and the die housing 12. The bullet seating die 10 includes a first spring retainer 32 and a second spring retainer 34. The spring 30 is disposed between and engages the first and second spring retainers 32, 34. While the spring 30 is shown in an uncompressed state in FIG. 3, it is understood that the spring would be compressed between the first and second spring retainers 32, 34 in this figure. The first spring retainer 32 is supported by the die housing 12. The first spring retainer 32 has a generally disk shaped body 36 sized and shaped to be inserted into the bore 20 of the die housing. The die housing 12 includes a shoulder 38 within the bore 20. The first spring retainer 32 (e.g., the disk shaped body 36) is disposed in the bore 20 and engages (e.g., rests on) the shoulder 38. The illustrated shoulder 38 is very narrow, such as about 0.5 mm. The first spring retainer 32 (e.g., a lower surface thereof) defines a closed end (e.g., closed upper end) of the bullet receiving space 22. The disk shaped body 36 of the first spring retainer 32 defines an opening 40 (e.g., a seating stem opening). The seating stem 28 extends through the opening 40 of the first spring retainer 32. The seating stem 28 is slidable within the opening 40 relative to the first spring retainer 32 to permit the position of the seating stem to be adjusted, as described in more detail below. One end (e.g., a first end) of the spring 30 engages the first spring retainer 32. In the illustrated embodiment, the disk shaped body 36 defines a spring recess 42. The spring recess 42 is aligned with the opening 40 and is sized and shaped to receive the end of the spring 30. The second spring retainer 34 is supported by the seating stem 28. In the illustrated embodiment, the second spring retainer 34 comprises an E-clip or a C-clip 44 mounted on the seating stem 28. The seating stem 28 includes a circumferential channel 46 (FIGS. 10A-C) that receives the E or C-clip 44. Another end (e.g., a second end) of the spring 30 engages the second spring retainer 32. In the illustrated embodiment, the spring 30 comprises a coil spring. The seating stem 28 extends through the coil spring.

Referring to FIGS. 2-4, the bullet seating die 10 includes a cap 48 supported by the die housing 12. In particular, the cap 48 is mounted on an end of the die housing 12. The cap 48 includes a seat 50 (FIG. 3). The seat 50 is arranged to engage the seating stem 28 (e.g., an end thereof) to set the position of the seating stem relative to the die housing 12. The spring 30 biases the seating stem 28 against the seat 50. In the illustrated embodiment, the seat 50 defines a recess 52 sized and shaped to receive the end the of the seating stem 28. The cap 48 includes an adjuster 54. The adjuster is configured to move the seat 50 relative to the die housing 12 to set the position of the seating stem 28 relative to the die housing. This allows the overall depth the bullet 1 is seated in the case 2 to be adjusted. Moving the seat 50 toward the open end of the bullet receiving space 22 (e.g. in one direction) compresses the spring 30 and moves the seating stem 28 toward the open end of the bullet receiving space. This increases the depth the bullet 1 is seated into the case 2. Moving the seat 50 away from the open end of the bullet receiving space 22 (e.g., in the opposite direction) permits the spring 30 to expand and moves the seating stem 28 away from the open end of the bullet receiving space. This decreases the depth the bullet 1 is seated into the case 2. In the illustrated embodiment, the adjuster 54 comprises a micrometer 56. The micrometer 56 is threadably connected to the die housing 12. The die housing 12 includes external threads that engage internal threads of the micrometer 56. The micrometer 56 is operatively coupled to the seat 50 with a fastener 58 such that the seat 30 moves longitudinal with the micrometer as the micrometer moves longitudinally along the die housing 12 when the micrometer is rotated. Rotating the micrometer 56 in one direction (e.g., a clockwise direction) moves the seat 50 and seating stem 28 toward the open end of the bullet receiving space 22 and rotating the micrometer in the opposite direction (e.g., a counter-clockwise direction) moves the seat and seating stem away from the open end of the bullet receiving space. Desirably, micrometer 56 enables precise (e.g., about 0.001 inch (about 0.025 mm)) adjustment to the seating depth of the bullet 1.

Figure 7:
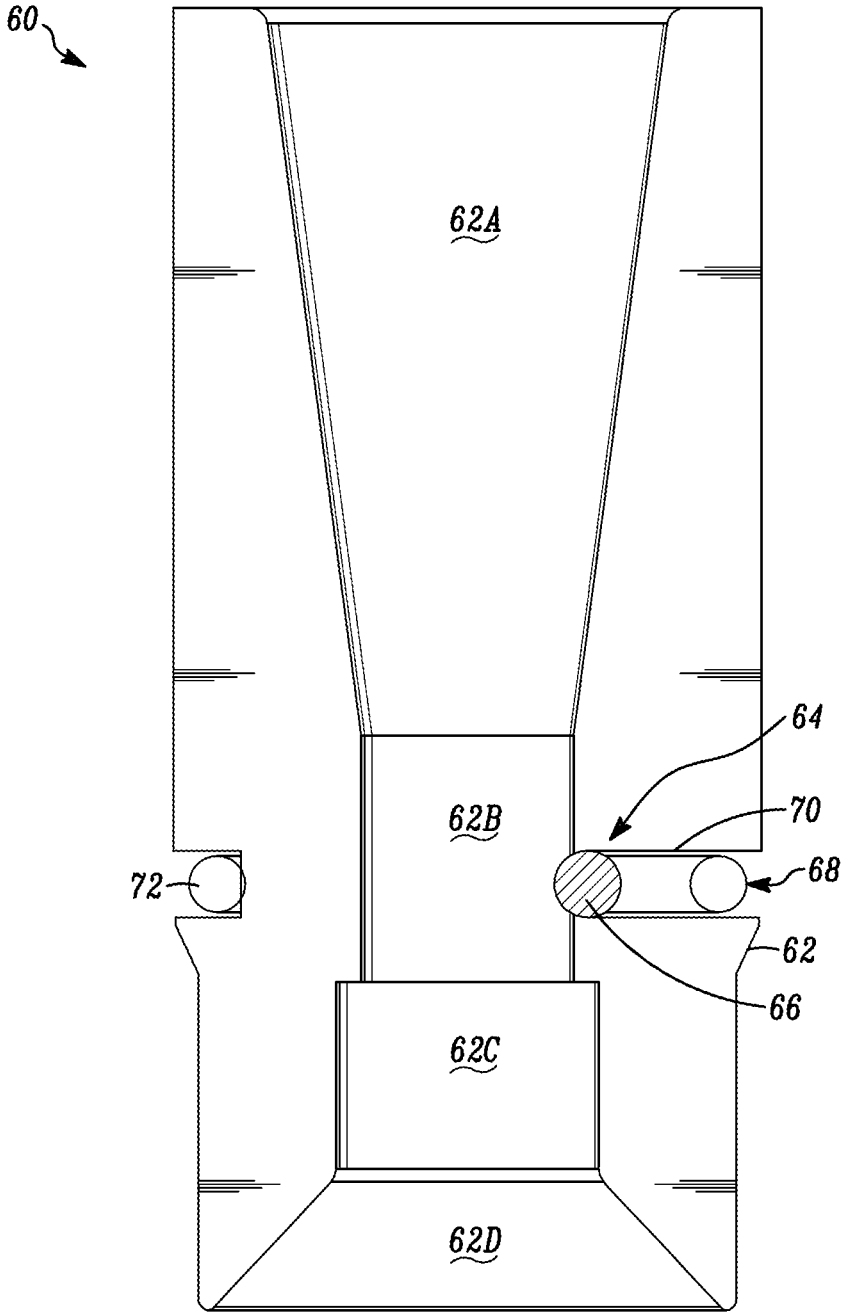
FIG. 7 is a cross-section of an alignment sleeve of the bullet seating die.
Figure 8:
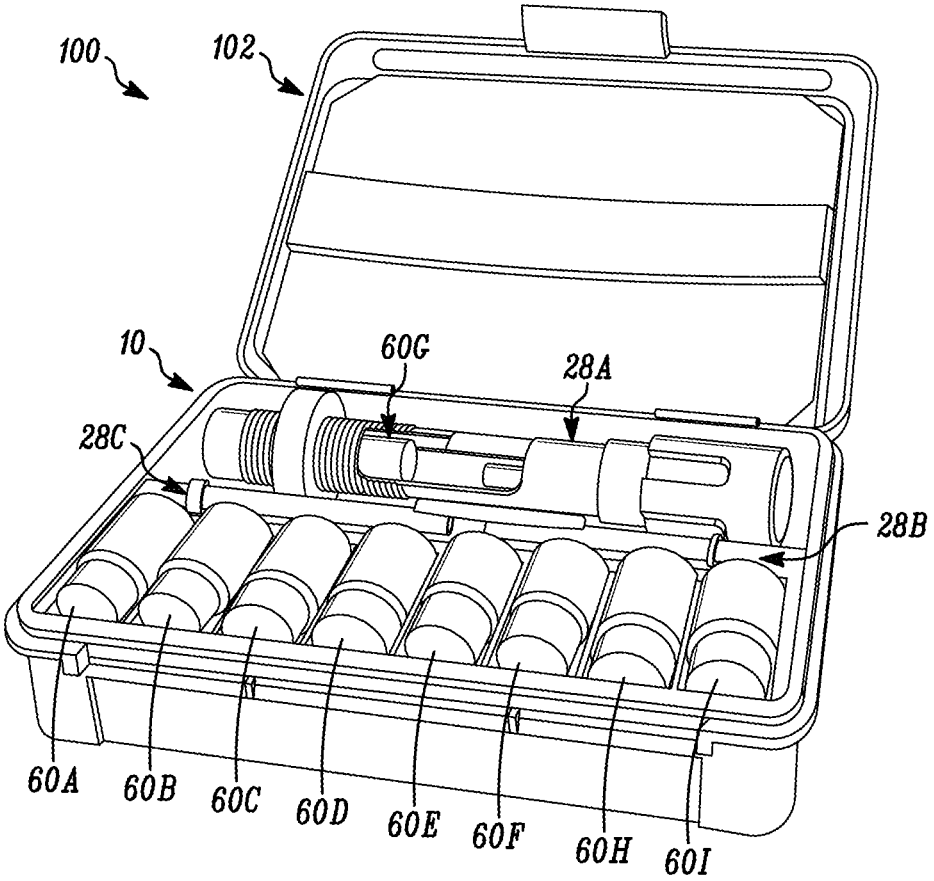
FIG. 8 is a perspective of a bullet seating die kit according to one embodiment of the present disclosure within a case.
Figure 9:
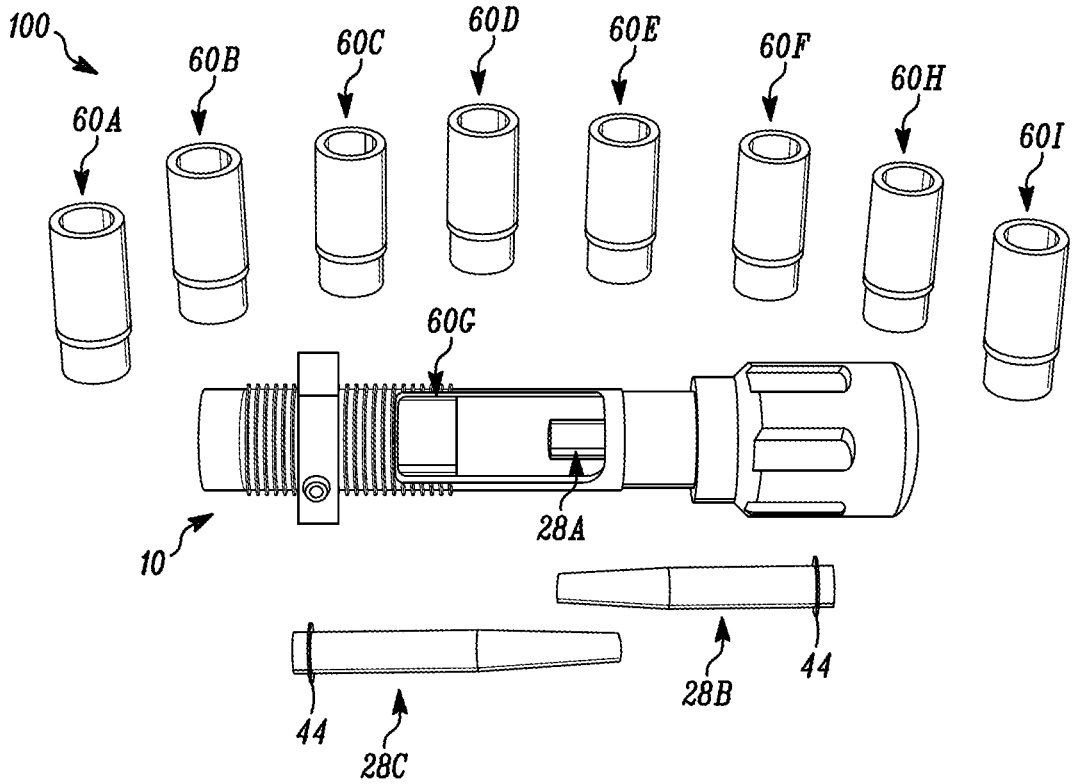
FIG. 9 is perspective of the bullet seating die kit.

Referring to FIGS. 3 and 7, the bullet seating die 10 includes an alignment sleeve 60. The alignment sleeve 60 is configured to guide the bullet 1 into the case 2 when the ammunition press 3 is operated. The alignment sleeve 60 is sized and shaped to be disposed within the bullet receiving space 22 and to slide within the bullet receiving space. The alignment sleeve 60 is generally cylindrical. The alignment sleeve 60 includes an exterior shoulder 62 that engages an interior shoulder 64 of the die housing 12 in the bore 20 to hold the alignment sleeve within the bullet receiving space 22 and prevent the alignment sleeve from sliding out of the open end of the bullet receiving space. The alignment sleeve 60 defines an alignment lumen 62 therethrough. The alignment lumen 62 includes a bullet guide section 62A, a bullet alignment section 62B, a case alignment section 62C and a case guide section 62D. The bullet guide section 62A, the bullet alignment section 62B, the case alignment section 62C and the case guide section 62D are arranged end to end from one end of the alignment sleeve 60 to the other. The bullet guide section 62A has an inverted conical shape and guides the bullet 1 into the bullet alignment section 62B when the bullet is inserted into the bullet receiving space 22. The case guide section 62D has a conical shape and guides the case 2 into the case alignment section 62C when the case is raised up into the bullet receiving die 10. The bullet alignment section 62B is arranged relative to the case alignment section 62C such that the bullet alignment section aligns and guides the bullet 1 into the case 2 when the bullet is seated in the case. The alignment lumen 62 is sized and shaped to seat a specific caliber bullet 1 into its corresponding specific caliber case 2. The bullet alignment section 62B has a diameter to match a specific caliber bullet 1, such as a.223 caliber bullet. Likewise, the case alignment section 62C has a diameter to match a specific caliber case 2 (same caliber as the bullet alignment section 62B), such as a.223 caliber case. The case alignment section 62C is sized and shaped (e.g., has a height) that allows the case alignment section to receive any case 2 of the caliber corresponding to the caliber of the case alignment section 62C. The case alignment section 62C is also sized to receive any wall thickness of a case 2, as a neck of the case (the portion that accepts the bullet 1) can vary between cases (even the same caliber cases). This allows the bullet seating die 10 (specifically, the alignment sleeve 60) to be used with any case 2 of a specific caliber (e.g., any.223 caliber case). It is understood, the alignment lumen 62 can be sized and shaped for generally any caliber such as .223, .243, .257, .264, .277, .284, .308, .325, .338, etc.

The alignment sleeve 60 includes a bullet retainer 64. The bullet retainer 64 is arranged to engage the bullet 1 (e.g., a lower end thereof) to hold the bullet within the bullet receiving space 22 when the bullet is placed in the bullet receiving space. Without the bullet retainer 64, the bullet 1 may fall out of the bullet seating die 10 (e.g., fall through the alignment lumen 62). By holding the bullet 1 in the bullet receiving space 22 with the bullet retainer 64, the user does not have to balance the bullet on top of a case 2 when operating the ammunition press. In the illustrated embodiment, the bullet retainer 64 comprises a cylindrical rod 66. In another embodiment, the bullet retainer may comprise a spring clip. The bullet retainer 64 is resiliently biased by a bullet retainer spring 68. The bullet retainer spring 68 biases the bullet retainer 64 into a retaining position (FIG. 7), where at least of portion of the bullet is disposed in the bullet alignment section 62B to engage the lower end of the bullet 1 to hold the bullet and prevent the bullet from falling through the bullet alignment section. In the illustrated embodiment, the rod 66 is slidably disposed within a channel 70. In operation, the bullet retainer 64 is moved out of the bullet alignment section 62B by the bullet 1, away from the retaining position, when the bullet is pressed by the seating stem 28. Specifically, the bullet 1 moves the rod 66 outward along the channel 70 and away from the retaining position when the bullet is pressed by the seating stem 28 to move the lower end of the bullet pass the bullet retainer 64 when the ammunition press 3 is operated. In the illustrated embodiment, the bullet retainer spring 68 comprises an O-ring 72. The O-ring 72 engages the opposite ends of the rod 66 to bias the rod toward the retaining position.

Referring to FIGS. 8-10C, the bullet seating die 10 may be part of a bullet seating die kit 100. The bullet seating die kit 100 includes the bullet seating die 10, a plurality of different alignment sleeves 60, and a plurality of different seating stems 28. The plurality of alignment sleeves 60 are all interchangeable with one another in the bullet seating die 10. Likewise, the plurality of seating stems 28 are also all interchangeable with one another in the bullet seating die 10. In the illustrated embodiment, the bullet seating die kit 100 includes a.224 caliber alignment sleeve 60A, a.243 caliber alignment sleeve 60B, a.257 caliber alignment sleeve 60C, a.264 caliber alignment sleeve 60D, a.277 caliber alignment sleeve 60E, a.284 caliber alignment sleeve 60F, a.308 caliber alignment sleeve 60G (shown in the bullet receiving space 22 of the die housing 12), a.325 caliber alignment sleeve 60H, and a.338 caliber alignment sleeve 60I. More or fewer alignment sleeves and/or other caliber alignment sleeves are within the scope of the present disclosure. By selecting (e.g., interchanging) a desired caliber alignment sleeve 60A-I, the bullet seating die 10 can be configured for a specific caliber of bullet 1. In addition, in the illustrated embodiment, the bullet seating die kit 100 includes a short-length seating stem 28A (shown mounted in the die housing 12), a medium-length seating stem 28B, and a long-length seating stem 28C. More or fewer seating stems and/or other lengths of seating stems are within the scope of the present disclosure. Bullets 1 and cases 2 come in different lengths (even for the same caliber). The different length seating stems 28A-C enable the bullet seating die 10 to be configured to match the length of bullet 1 and/or case 2 being seated together in order to properly set the depth the bullet is seated in the case. For example, a 2.2 inch long case requires a different configuration then a 3.3 inch long case. By selecting a seating stem 28A-C of a specific length, the desired seating depth can be achieved. It is understood that the adjuster 54 is used for more fine tune adjustments than interchanging seating stems 28A-C of different lengths allows (e.g., selecting a seating stem of a specific length allows for large scale adjustments). The seating stems 28A-C are configured to be used with multiple caliber bullets (e.g., the seating stems are not caliber specific). For example, the taper at the end of the medium-length and long-length seating stems 28B-C enables these seating stems to be used with different (e.g., smaller) caliber alignment sleeves 60A-I and their corresponding bullets 1. The bullet seating die kit 100 may include a box or case 102 for housing the components (e.g., bullet seating die 10, alignment sleeves 60A-I, seating stems 28A-C) of the kit.

To change out the seating stem 28 and/or alignment sleeve 60 of the bullet seating die 10, a user removes the cap 48 from the end of the die housing 12. The user unscrews the adjuster 54 from the end of the die housing 12. This opens up the end of the bore 20 and allows the seating stem 28, the spring 30, the first spring retainer 32, and the alignment sleeve 60 to be removed from the bore. The seating stem 28, the spring 30, the first spring retainer 32, and the alignment sleeve 60 can all slide out of the bore 20 through the end previous closed by the cap 48 (e.g., the end opposite the open end of the bullet receiving space 22). After the seating stem 28 and the alignment sleeve 60 are removed from the die housing 12, the user can interchange the existing seating stem and/or alignment sleeve with another (e.g., different size) seating stem and/or alignment sleeve, respectively, as desired to configure the bullet seating die 10 to the desired caliber and size of the bullet 1 and the case 2 that are being seated together. To reassemble the bullet seating die 10, the user inserts the desired alignment sleeve 60 (e.g., one of alignment sleeves 60A-I), case guide section 52D first, into the bore 20 of the die housing 12. The alignment sleeve 60 slides down the bore 20 and engages the shoulder 64 of the die housing 12, positioning the alignment sleeve in the bullet receiving space 22. After, the user inserts the first spring retainer 32 and then the spring 30 into to the bore 20 of the die housing 12. Then, the user inserts the desired seating stem 28 (e.g., one of seating stems 28A-C) into the bore 20 of the die housing 12, making sure the seating stem is aligned with the opening 40 in the first spring retainer so that the seating stem slides therein. Lastly, the user reattaches the cap 48 to the end of the die housing 12. The user screws the adjuster 54 onto the end of the die housing 12. The bullet seating die 10 can then be mounted onto the ammunition press (if not already).

A method of seating a bullet 1 in a case 2 using the bullet seating die 10 will now be described. The user configures the bullet seating die 10 by selecting the appropriate alignment sleeve 60 and/or seating stem 28 for the bullet 1 and case 2 to be seated or loaded. The user installs the selected alignment sleeve 60 and/or seating stem 28 into the die housing 12 as described herein. After the bullet seating die 10 is assembled, the user mounts the bullet seating die 10 on the ammunition press 3, as described herein. The bullet seating die 10 can then be adjusted to set the desired depth of the bullet 1 in the case 2. The user actuates the adjuster 54 (e.g., rotates the micrometer 56) to adjust the position of (e.g., move) the seating stem 28 relative to the die housing 12 to set the seating depth of the bullet 1 in the case 2. Now the ammunition press 3 is ready to seat a bullet 1 in a case 2. The user puts the case 2 in the ammunition press 3. The user also places the bullet 1 in the bullet receiving space 22. The bullet 1 is inserted through the side window 26 and into the bullet receiving space 22. The user inserts the bullet 1 under the seating stem 28, which is biased away from the lower end of the side window 26. Because the seating stem 28 is held up or biased by the spring 30, the user does not need to move the seating stem in order to place the bullet 1 into the bullet receiving space 22. This makes placing the bullet 1 in the bullet receiving space 22 easier over conventional seating dies. When the bullet 1 is in the bullet receiving space 22, the bullet retainer 64 engages the bullet to hold the bullet in the bullet receiving space. With the bullet 1 positioned in the bullet seating die 10, the user then operates the ammunition press 3. The ammunition press 3 may include a lever the user turns to operate the ammunition press. When the ammunition press 3 is operated, the case 2 is raised by the press toward the bullet 1 in the bullet seating die 10. As the case 2 is raised, the upper end of the case moves into the alignment sleeve 60 (e.g., the case alignment section 62C). The case 2 engages the alignment sleeve 60 and pushes the alignment sleeve and bullet 1 upward within the bullet receiving space 22 toward the seating stem 28. Eventually, the nose of bullet 1 engages the end (e.g., lower end) of the seating stem 28, thereby preventing any further upward movement of the bullet. Continued upward movement of the case 2 and the alignment sleeve 60 by the ammunition press 3 seats the bullet 1 in the case. The engagement of the bullet 1 with the seating stem 28 prevents further upward movement of the bullet so that as the press continues to move the case 2 and alignment sleeve 60 upward, the bullet deflects the bullet retainer 64 and is pushed into the case. The ammunition press 3 is continued to be operated until the case 2 is raised to its upper most point, which seats the bullet 1 in the case at the seating depth. The ammunition press 3 is then operated to lower the case 2. As the case 2 is lowered, the case brings the now seated bullet 1 with the case and the case and bullet withdraw from the alignment sleeve 60. The alignment sleeve 60 rests at the bottom of the die housing 12, ready to receive the next bullet from the side window 26. The user removes the seated bullet 1 and case 2 from the ammunition press 3 and then repeats the process with the next bullet and case.

When introducing elements of the present disclosure or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

It will be apparent that modifications and variations are possible without departing from the scope defined in the appended claims.

As various changes could be made in the above constructions and methods without departing from the scope of the disclosure, it is intended that all matter contained in the above description and shown in the accompanying drawings shall be interpreted as illustrative and not in a limiting sense.

What is claimed is:

1. A bullet seating die for use with an ammunition press to seat a bullet in a case, the bullet seating die comprising:

a die housing having an ammunition press mount configured to mount the bullet seating die on the ammunition press, the die housing defining a bullet receiving space having an open end, the die housing defining a side window in communication with the bullet receiving space and sized and shaped to permit the bullet to be inserted therethrough to position the bullet in the bullet receiving space; and a seating stem supported by the die housing within the bullet receiving space, the seating stem arranged to engage the bullet to press the bullet into the case when the ammunition press is operated;

a spring retainer supported by the die housing;

a bullet holder configured to be receivable in the bullet receiving space, the bullet holder being configured to hold the bullet, the bullet holder being moveable with respect to the spring retainer; and a spring biasing the seating stem away from the open end of the bullet receiving space so that the seating stem is positioned relative to the side window to permit the bullet to be inserted through the side window and into the bullet receiving space.

2. The bullet seating die of claim 1, wherein the spring is operatively disposed between the seating stem and the die housing.

3. The bullet seating die of claim 2, wherein the spring retainer is a first spring retainer supported by the die housing, a first end of the spring engaging the first spring retainer.

4. The bullet seating die of claim 3, further comprising a second spring retainer supported by the seating stem, a second end of the spring engaging the second spring retainer.

5. The bullet seating die of claim 4, wherein the spring comprises a coil spring, the seating stem extending through the coil spring.

6. The bullet seating die of claim 5, wherein the die housing defines an elongate bore and includes a shoulder within the elongate bore, the first spring retainer disposed in the elongate bore and engaging the shoulder.

7. The bullet seating die of claim 6, wherein the first spring retainer defines an end of the bullet receiving space.

8. The bullet seating die of claim 3, wherein the first spring retainer defines an opening, the seating stem extending through the opening and slidable within the opening relative to the first spring retainer.

9. The bullet seating die of claim 1, further comprising a cap supported by the die housing, the cap including a seat, the spring biasing the seating stem against the seat.

10. The bullet seating die of claim 9, wherein the cap includes an adjuster configured to move the seat relative to the die housing to set the position of the seating stem relative to the die housing.

11. The bullet seating die of claim 10, wherein the adjuster comprises a micrometer threadably connected to the die housing.

12. The bullet seating die of claim 1, further comprising an alignment sleeve configured to guide the bullet into the case when the ammunition press is operated, the alignment sleeve including a bullet retainer arranged to engage the bullet to hold the bullet within the bullet receiving space.

13. The bullet seating die of claim 12, wherein the bullet retainer is resiliently biased by a bullet retainer spring.

14. The bullet seating die of claim 13, wherein the bullet retainer spring comprises an O-ring.

15. The bullet seating die of claim 1, wherein a first shoulder limits downward movement of the spring retainer, a second shoulder limits downward movement of the bullet holder.

16. The bullet seating die of claim 1, wherein the bullet holder is moveable without compressing the spring.

17. The bullet seating die of claim 1, wherein the bullet holder is free of resistance from the spring opposing upward motion of the bullet holder.

18. A bullet seating die for use with an ammunition press to seat a bullet in a case, the bullet seating die comprising:

a die housing having an ammunition press mount configured to mount the bullet seating die on the ammunition press, the die housing defining a bullet receiving space having an open end, the die housing defining a side window in communication with the bullet receiving space and sized and shaped to permit the bullet to be inserted therethrough to position the bullet in the bullet receiving space; and a seating stem supported by the die housing within the bullet receiving space, the seating stem arranged to engage the bullet to press the bullet into the case when the ammunition press is operated;

a spring biasing the seating stem away from the open end of the bullet receiving space so that the seating stem is positioned relative to the side window to permit the bullet to be inserted through the side window and into the bullet receiving space;

wherein the spring is operatively disposed between the seating stem and the die housing;

further comprising a first spring retainer supported by the die housing, a first end of the spring engaging the first spring retainer;

further comprising a second spring retainer supported by the seating stem, a second end of the spring engaging the second spring retainer wherein the spring comprises a coil spring, the seating stem extending through the coil spring;

wherein the die housing defines an elongate bore and includes a shoulder within the elongate bore, the first spring retainer disposed in the elongate bore and engaging the shoulder;

and, wherein the second spring retainer comprises an E-clip mounted on the seating stem.

19. A method of seating a bullet in a case using an ammunition press, the method comprising:

providing a bullet seating die mounted on the ammunition press, the bullet seating die including a seating stem and a side window configured to receive a bullet into a bullet receiving space generally into alignment with the seating stem, the seating stem being biased by a spring supported by a housing of the bullet seating die away from a lower end of the side window;

placing the bullet in the bullet receiving space of the bullet seating die, wherein the seating stem does not need to be moved to place the bullet into the bullet receiving space; and operating the ammunition press to move the case and the bullet toward the seating stem without deflecting the spring biasing the seating stem to seat the bullet in the case.

20. The method of claim 19, further comprising holding the bullet in the bullet receiving space with a retainer.

21. The method of claim 19, further comprising adjusting a position of the seating stem using an adjuster of the bullet seating die.

22. The method of claim 19, further comprising positioning an alignment sleeve in the bullet receiving space.

23. A bullet seating die for use with an ammunition press to seat a bullet in a case, the bullet seating die comprising:

a die housing having an ammunition press mount configured to mount the bullet seating die on the ammunition press, the die housing defining a bullet receiving space having an open end, the die housing defining a side window in communication with the bullet receiving space and sized and shaped to permit the bullet to be inserted therethrough to position the bullet in the bullet receiving space; and a seating stem supported by the die housing within the bullet receiving space, the seating stem arranged to engage the bullet to press the bullet into the case when the ammunition press is operated;

a spring biasing the seating stem away from the open end of the bullet receiving space so that the seating stem is positioned relative to the side window to permit the bullet to be inserted through the side window and into the bullet receiving space;

wherein the spring is operatively disposed between the seating stem and the die housing;

a first spring retainer supported by the die housing, a first end of the spring engaging the first spring retainer; and a second spring retainer carried by the seating stem and selectively removable from the seating stem.

24. The bullet seating die of claim 23, wherein the second spring retainer is a clip selectively removable from the seating stem.

* * * * *